US005743185A

United States Patent [19]

Hippely et al.

[11] Patent Number: 5,743,185

[45] Date of Patent: Apr. 28, 1998

[54] FLEXIBLE THERMALLY CONDUCTIVE STAMP AND MATERIAL

[75] Inventors: Keith A. Hippely, Manhattan Beach; Terence A. Choy, Lawndale; Kevin W. Gray, San Pedro; Brian E. Walsh, Mission Hills, all of Calif.

[73] Assignee: Mattel, Inc., El Segundo, Calif.

[21] Appl. No.: 854,423

[22] Filed: May 12, 1997

Related U.S. Application Data

[63] Continuation of Ser. No. 373,921, Jan. 17, 1995, abandoned.

[51] Int. Cl.[6] ..... B41F 31/00

[52] U.S. Cl. ..... 101/327; 101/109

[58] Field of Search ..... 101/103, 109, 101/327, 333, 368, 405, 406

[56] References Cited

U.S. PATENT DOCUMENTS

| | | | |
|---|---|---|---|
| D. 25,167 | 2/1896 | Strang . | |
| D. 272,363 | 1/1984 | Matsumuro . | |
| D. 334,399 | 3/1993 | Ziegler . | |
| 1,607,660 | 11/1926 | Zabriskie . | |
| 3,609,104 | 9/1971 | Ehrreich . | |
| 3,808,046 | 4/1974 | Davey . | |
| 3,973,111 | 8/1976 | Washizuka et al. . | |
| 4,078,031 | 3/1978 | Bishop | 101/401.1 |
| 4,134,853 | 1/1979 | Ehrlich et al. . | |
| 4,205,137 | 5/1980 | Akiyama | 521/145 |
| 4,690,053 | 9/1987 | Munyon et al. . | |
| 4,774,269 | 9/1988 | Thum . | |
| 4,782,893 | 11/1988 | Thomas . | |
| 4,924,773 | 5/1990 | Gwilliam . | |
| 4,928,594 | 5/1990 | Bostick . | |
| 4,936,699 | 6/1990 | Yoshida . | |
| 5,011,445 | 4/1991 | Nakasuji et al. . | |
| 5,057,903 | 10/1991 | Olla . | |
| 5,178,067 | 1/1993 | Collier . | |
| 5,223,958 | 6/1993 | Berry . | |
| 5,253,581 | 10/1993 | Miki et al. . | |
| 5,329,848 | 7/1994 | Yasui et al. . | |
| 5,503,648 | 4/1994 | Shih . | |

FOREIGN PATENT DOCUMENTS

| | | |
|---|---|---|
| 329993 | 11/1992 | Japan . |
| 39151 | 2/1994 | Japan . |
| 39152 | 2/1994 | Japan . |

*Primary Examiner*—Ren Yan

*Attorney, Agent, or Firm*—Roy A. Ekstrand

[57] ABSTRACT

A flexible thermally conductive stamp and material is fabricated of a support handle and a heat conductive member. The heat conductive member supports raised image portions which together with the heat conductive member are formed of a flexible resilient thermally conductive material. The thermally conductive material is preferably fabricated of a mixture of Plastisol and aluminum powder. Portions of the raised image area of the stamp include angled side surfaces which improve the thermal conductivity of the stamp.

13 Claims, 1 Drawing Sheet

FLEXIBLE THERMALLY CONDUCTIVE STAMP AND MATERIAL

This application is a continuation of application Ser. No. 08/373,921, filed Jan. 17, 1995 now abandoned.

FIELD OF THE INVENTION

This invention relates generally to thermochromic toys and other products and particularly to the thermally conductive stamps used in conjunction therewith.

BACKGROUND OF THE INVENTION

Thermochromic paints and coatings have proven to be a substantial asset to manufacturers of products such as toys in increasing the diversity and play value of their products. The basic property of thermochromic materials is the capability of changing color in response to changes in temperature. For example, in the toy industry, the extensive use of thermochromic materials has included toy vehicles, dolls having thermochromic facial features, and small toy figures having thermochromic coated areas. Of the various toy types using thermochromic materials, one of the most popular involves thermochromic coated or painted toy vehicles. Such toys are often called "color change" toy vehicles, the outer surface or at least a portion thereof of the toy vehicle is painted or otherwise coated with a thermochromic material. The toy vehicle may then be alternatively immersed in hot or cold water baths or subjected to hot or cold water sprays etc. to utilize the color change capability. In many such color change products, the patterns of images are also changed as the vehicle undergoes temperature change.

In addition to toy vehicle or other toy color change products which are immersed for complete color change, other related color change products such as writing materials, games, educational materials and gifts or novelty items have also been provided. Practitioners in the art have also provided accessories in the form of thermally conductive stamps or writing implements which allow localized color change on the product. For example, a toy vehicle immersed in a cold water bath and thereafter assuming a particular color may be written upon using a heated writing instrument or the like. Similarly, a heated stamp applied to a cold color thermochromic coated toy vehicle then bears the stamp image as a result of localized heating of the thermochromic material. While the writing instruments used in combination with thermochromic materials have enjoyed some success, heat conductive stamps used therewith have, in many instances, been disappointing in their performance.

Several problems exist in temperature change or thermally conductive stamps. For example, the image portion of such stamps often lacks thermal capacity to adequately change the thermochromic material. This is particularly evident in thinner image elements of the stamp image. In addition, such stamps must, of necessity, be fashioned of a thermally conductive material which typically do not work well on curved surfaces generally evident in toy vehicles or the like. Finally, the slippery character of the stamped surfaces often allows the stamp to slide or shift slightly during color change thereby producing a blurred or smudged image.

Despite the problems associated with thermochromic toy products, their continued popularity in the marketplace has motivated practitioners in the art to continue their development of such products. For example, U.S. Pat. No. 5,011,445 issued to Nakasuji, et al. sets forth a COLOR MEMORY TOY SET having a toy supporting at least one surface provided with color change material. A writing pen includes an elongated cylindrical housing having an interior cavity and a thermally conductive writing nib extending therefrom. A quantity of heated or cooled liquid such as water is received within the interior cavity to provide a hot or cold writing nib which provides localized color change on the thermochromic portion of the toy.

Japanese Patent 6-39151(A) issued to Nakagawa sets forth a COLOR CHANGE TOOL having an elongated cylinder supporting a forwardly extending heat conductive tip together with a thermoelectric transducing element and battery power source in communication with the thermoelectric chip. The energy of the battery power source heats the transducing element which in turn heats the head conductive tip.

Japanese Patent 4,329,993(A) issued to Nakagawa sets forth a TOOL SET DISCOLORED BY HEATING AND COOLING having an elongated cylindrical housing supporting a thermoelectric transducing element and heat conductive member together with a battery- powered source. The thermoelectric transducing element includes both exothermic and endothermic elements for heating and cooling using battery power.

Japanese Patent 6-39152(A) issued to Nakagawa sets forth a COLOR CHANGE TOOL having an elongated cylindrical housing supporting a thermally conductive tip and a thermoelectric transducer together with a battery power source.

U.S. Pat. No. 5,223,958 issued to Berry sets forth a HEAT ACTIVATED AMUSEMENT DEVICE EMPLOYING MICROENCAPSULATED THERMOCHROMIC LIQUID CRYSTAL having a generally planar substrate upon which a latent image is obscured by a thermochromic covering. Once the temperature of the thermochromic covering is changed, the latent image is then visible.

In addition to thermochromic materials, practitioners in the art have provided a variety of different stamp and inking type apparatus. For example, U.S. Pat. No. Des. 334,399 issued to Ziegler sets forth an INK DAUBER having a cylindrical ink reservoir and porous stamp operatively coupled. The porous stamp is provided with a number of interchangeable heads having different shapes for image stamping.

U.S. Pat. No. Des. 272,363 issued to Matsumuro sets forth a COMBINED DECORATION STAMP AND CAP having a housing supporting a supply of ink and a stamping element.

U.S. Pat. No. 1,607,660 issued to Zabriskie sets forth a GAME having, in pertinent part, a plurality of stampers utilizing planar disk-like supports bearing image elements raised on one surface thereof and an elongated handle on the opposite surface.

U.S. Pat. No. 4,690,053 issued to Munyon, et al. sets forth a ROLLER STAMP CONSTRUCTION having an elongated handle coupled to a generally U-shaped frame which in turn rotatably supports a cylindrical stamp member.

U.S. Pat. No. 4,924,773 issued to Gwilliam sets forth a HAND STAMP WITH RESERVOIR having an elongated cylindrical reservoir and a generally cube-shaped stamp configuration each independently coupled to the cylindrical reservoir and each bearing a different raised stamp image.

U.S. Pat. No. 4,928,594 issued to Bostic sets forth a FOLDABLE RUBBER STAMP HANDLE having a raised image embossing facet supported by a plurality of hingedly coupled planar handle portions which may be configured in a gripping configuration or a folded configuration.

U.S. Pat. No. 4,936,699 issued to Yoshida sets forth TOY ACCESSORIES having a ring-like base member supporting a plurality of stamp elements in a snap-fit attachment.

U.S. Pat. No. 5,178,067 issued to Collier sets forth a SPECIAL EFFECTS RUBBER STAMP having an elongated stamp housing supporting a sound producing circuit therein. The sound producing circuit is operatively coupled to a sensing switch which responds to stamp embossing to produce sound associated therewith.

U.S. Pat. No. 5,303,648 issued to Shih sets forth a ROLLER STAMP having a housing resembling a toy vehicle and supported by a plurality of rolling wheels. A rolling stamp wheel and inking roller are further supported within the housing producing an embossed line of stamped images as the toy vehicle is rolled across a surface.

U.S. Pat. No. 25,167 issued to Strang sets forth a BREAD KNEADER having a generally disk-shaped embossing member supporting a plurality of embossing facets coupled to an elongated handle.

U.S. Pat. No. 4,782,893 issued to Thomas sets forth an ELECTRICALLY INSULATING THERMALLY CONDUCTIVE PAD FOR MOUNTING ELECTRONIC COMPONENTS formed of a thin film of dielectric strength material which is impregnated with diamond powder.

U.S. Pat. No. 4,774,269 to Thum sets forth a PROCESS FOR THE PREPARATION OF A FILLED POLYOLEFIN MOLDING MATERIAL having a very high filler content and containing no filler free polymer and no polymer free filler.

U.S. Pat. No. 3,808,046 issued to Davey sets forth a METALIZING PASTE suitable for forming an adherent electrically and thermally conductive metal containing deposit on a ceramic surface.

U.S. Pat. No. 3,609,104 issued to Ehrreich, et al. sets forth an ELECTRICALLY CONDUCTIVE GASKET AND MATERIAL THEREOF forming an article loaded with a filler providing good electrical or heat conductivity formed by mixing the filler with particles of nonflowing compressible resin together with a sufficient amount of flowable resin.

U.S. Pat. No. 5,329,848 issued to Yasui, et al. sets forth a STAMP DEVICE CAPABLE OF PERFORATING THERMAL STENCIL PAPER for eliminating wasteful use of thermal stencil paper and thereby providing an inexpensive stamp device. A single thermal head is used for both the thermal recording on a reversible thermal recording sheet and for confirmation of a stamp image.

U.S. Pat. No. 5,253,581 issued to Miki, et al. sets forth a STAMP DEVICE EMPLOYING A HEAT SENSITIVE STENCIL PAPER TO BE PERFORATED BY HEAT OF A THERMAL HEAD which does not require manual application of ink to the stencil. Data concerning an image is input by an input unit, a thermal head generates heat on the basis of the data and transmits the heat to the thermal stencil paper disposed at the printing position.

U.S. Pat. No. 5,057,903 issued to Olla sets forth a THERMAL HEAT SINK INCAPSULATED INTEGRATED CIRCUIT which includes an integrated circuit die having a plurality of electrical leaves extending from the die. A thermal heat sink is positioned adjacent the die and includes a thermoplastic material having a plurality of thermoconductive particles molded therein.

U.S. Pat. No. 3,973,111 issued to Washizuka, et al. sets forth a CALCULATOR HAVING THERMAL PRINTING HEAD having the printing head exposed to the ambient environment to enable printing in a stamp-like fashion on thermal responsive paper.

U.S. Pat. No. 4,134,853 issued to Ehrlich, et al. sets forth a PHOTOCHROMIC COMPOSITION consisting essentially of titanium dioxide, ferric oxide and lead nitrate.

While the foregoing described prior art devices have provided improvement in their respective art and have in some instances enjoyed commercial success, there remains nonetheless a continuing need in the art for ever improved thermally conductive stamps and materials therefor.

SUMMARY OF THE INVENTION

Accordingly, it is a general object of the present invention to provide an improved thermally conductive stamp. It is a more particular object of the present invention to provide an improved thermally conductive stamp which is particularly well suited for use in combination with thermochromic products. It is a still further object of the present invention to provide an improved thermally conductive stamp for use with thermochromic products having curved or complexly curved surfaces.

In accordance with the present invention, there is provided for use in combination with a toy having a curved surface covered with a thermochromic material, a thermally conductive stamp comprising: a handle; and a heat conductive member formed of a flexible, resilient thermally conductive material, the toy and the heat conductive member being subjected to substantially different temperatures after which the heat conductive member is forced against a portion of the curved surface and conforms thereto whereby heat is transferred between the contacted portion of the curved surface and the heat conductive member to form an image.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
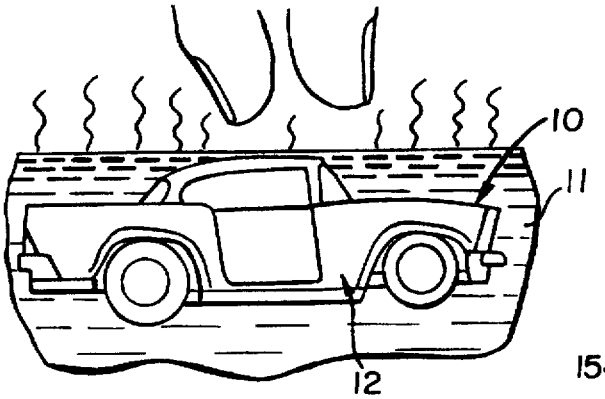
FIG. 1 sets forth a toy vehicle immersed in a hot water bath in preparation for the application of the present invention thermally conductive stamp.

FIG. 1 sets forth a toy vehicle generally referenced by numeral 10 having an outer surface 12 covered with a thermochromic material. Toy vehicle 10 is immersed in a heated water bath 11 in preparation for application of the present invention thermally conductive stamp.

Figure 2:
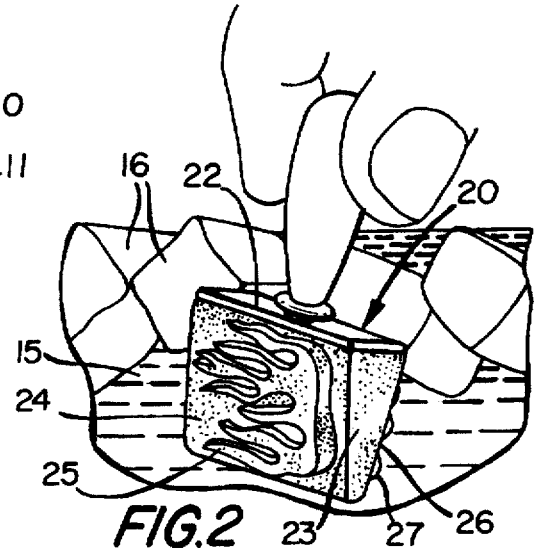
FIG. 2 sets forth the present invention stamp being cooled in a bath of cold water.

FIG. 2 sets forth a perspective view of a thermally conductive stamp constructed in accordance with the present invention and generally referenced by numeral 20. Stamp 20 includes an elongated handle 21 coupled to a support member 22. A generally triangular heat conductive member 23 is formed of a soft flexible resilient thermally conductive material described below. Heat conductive member 23 is secured to support 22 and defines a pair of facets 24 and 26 each of which supports a raised image 25 and 27 respectively. The fabrication of heat conductive member 23 and the material used therein is set forth below in greater detail. However, suffice it to note here that the heat conductive material utilized to form conductive member 23 provides a stamp member which is somewhat soft and flexible while being resilient and which exhibits a high thermal conductivity. Stamp 20 is immersed within a cold water bath 15 which is maintained at a low temperature by a plurality of ice cubes 16. In its preferred form, raised images 25 and 27 are integrally formed with heat conductive member 23 and thus provide resilient flexible image element surfaces used in the manner described below.

It will be apparent to those skilled in the art that while FIGS. 1 and 2 set forth the use of the present invention thermally conductive stamp in a combination in which the thermochromic outer surface of toy vehicle 10 is heated while heat conductive member 23 of stamp 20 is cooled, the opposite combination may be used. That is to say, alternatively, toy vehicle 10 may be cooled and heat conductive member 23 of stamp 20 may be heated to utilize the present invention. The essential element is the difference in temperature between the toy vehicle and heat conductive member 23 of stamp 20.

Figure 3:
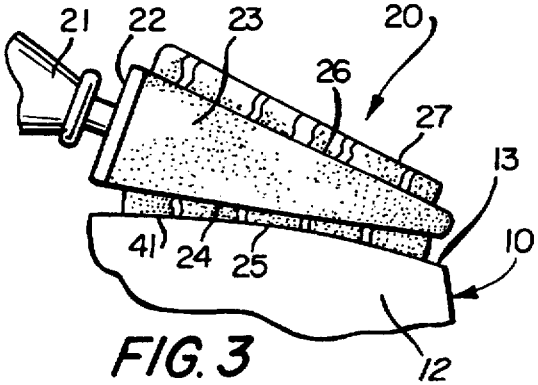
FIG. 3 sets forth a partial section side view of the present invention stamp applied to a typical toy vehicle surface.

FIG. 3 sets forth the present invention thermally conductive stamp applied to a portion of toy vehicle 10. As described above, the outer surface of toy vehicle 10 is covered with a thermochromic surface 12. More specifically, toy vehicle 10 defines a curved surface 13 which, as is better seen in FIG. 4, comprises the curved hood portion of toy vehicle 10. While this surface is utilized for illustration of the present invention thermally conductive stamp, it will be apparent to those skilled in the art that the present invention stamp may be utilized upon virtually any surface of a toy bearing a thermochromic surface. The particular advantage of the present invention thermally conductive stamp is found in its capability to accommodate a curved surface such as curved surface 13 due to its flexibility and resilience.

Thus, stamp 20 includes a handle 21 coupled to a support 22 which in turn is coupled to a heat conductive member 23. As described above, heat conductive member 23 is fabricated of a thermally conductive resilient soft material described below. Heat conductive member 23 is formed in a generally triangular shape defining opposed facets 24 and 26 which in turn define raised image portions 25 and 27. Once again, in its preferred form, heat conductive member 23 together with raised image portions 25 and 27 are preferably formed of an integral molded member to provide optimum flexibility and thermal conductivity. In some applications, however, it is recognized that portions of heat conductive member 23 may be fabricated of other materials to provide the required thermal capacity or conductivity while utilizing raised image portions 25 and 27 fabricated of the inventive material set forth below.

In operation, the previously heated toy vehicle 10 and the previously cooled stamp 20 are utilized in the manner shown in FIG. 3 as the user places raised image element 25 against curved surface 13 of toy vehicle 10. In this application, an important aspect of the present invention thermally conductive stamp becomes apparent in that the curvature of curved surface 13 is accommodated by the flexible resilient character of heat conductive member 23 and raised image portion 25. As can be seen, the generally planar outer surface of raised image portion 25 has flexed to accommodate the curvature of curved surface 13. Thus, a full surface contact for image portion 25 is maintained despite the curvature of surface 13 which in turn maximizes the heat transfer between the thermochromic material upon curved surface 13 and heat conductive member 23. In addition and in accordance with the material properties of heat conductive member 23 described below, the flexible resilient material of heat conductive member 23 enables stamp 20 to generally stick to or avoid sliding upon curved surface 13. This provides a sharper image and overcomes a serious problem in other thermochromic type writing instruments or stamps. Finally, it should be noted that as is described below in FIG. 6 in greater detail, portions of raised image 25 define angled surfaces such as angled surface 41 which increase the thermal conductivity of raised image 25 and provide better thermal image transfer. This is particularly true of those portions of the image elements which are small in surface area or "thin". Once stamp 20 has been maintained against curved surface 13 for a sufficient time for thermal transfer to have taken place, stamp 20 is removed from surface 13 revealing an image such as image 30 shown in FIG. 4.

Figure 4:
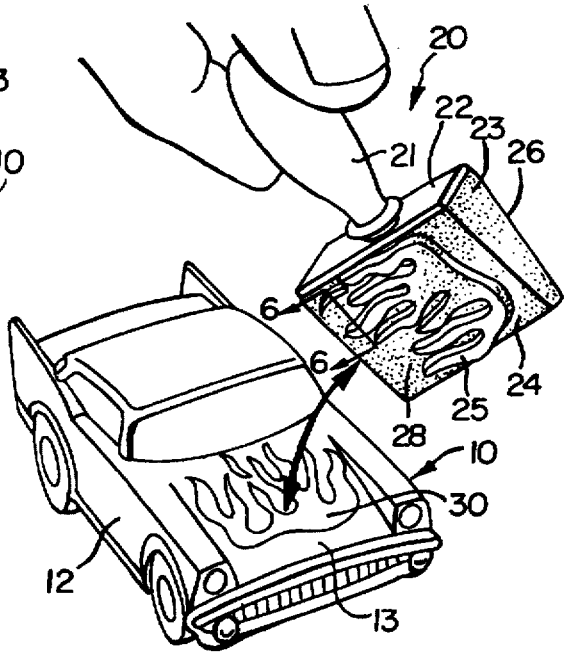
FIG. 4 sets forth a perspective view of the present invention thermally conductive stamp applied to a toy vehicle.

FIG. 4 sets forth a perspective view of toy vehicle toy as stamp 20 is removed to expose the created image upon the toy vehicle. As described above, toy vehicle 10 defines a thermochromic outer surface 12 which includes a curved hood surface 13. As a result of the above-described stamping action, curved surface 13 of toy vehicle 10 now bears an image 30 which corresponds to raised image portion 25 of stamp 20. As is also described above, stamp 20 includes a handle 21 coupled to a support 22 which in turn supports a heat conductive member 23. Heat conductive member 23 defines opposed facets 24 and 26 having raised image portions 25 and 27 (the latter seen in FIG. 3). Of interest to one particular advantage of the present invention is the content of a plurality of thin image elements such as thin portion 28 of image 25 within the present invention stamp. In the manner set forth in FIG. 6 in greater detail, the effectiveness of the present invention stamp in preserving the thin image elements is enhanced by providing angled surfaces adjacent such thin image elements. Suffice it to note here that in accordance with the present invention, the entirety of image 25 is imparted to curved surface 13 of toy vehicle 10 notwithstanding the curvature of surface 13.

It will be appreciated by those skilled in the art that while a toy vehicle has been illustrated as the cooperating thermochromic product for use in combination with present invention, other types of thermochromic toys or products such as dolls, toy figures, novelty items or the like may also be utilized in combination with the present invention thermally conductive stamp.

Figure 5:
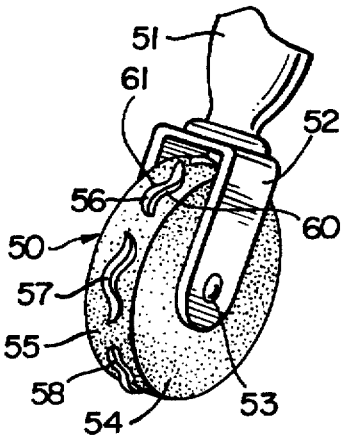
FIG. 5 sets forth a perspective view of an alternate embodiment of the present invention thermally conductive stamp.

FIG. 5 sets forth a perspective view of an alternate embodiment of the present invention thermally conductive stamp generally referenced by numeral 50. Stamp 50 includes an elongated handle 51 coupled to a generally U-shaped frame 52. A generally cylindrical thermally conductive wheel 54 is rotatably secured to frame 52 by an axle 53. Thermally conductive wheel 54 defines an outer cylindrical surface 55 which in turn supports a plurality of raised image elements such as image elements 56, 57 and 58. In accordance with the present invention, raised image element 56 defines angled side surfaces 60 and 61 to improve the thermal conductivity of the image element. Thermally conductive wheel 54 and the raised image element formed thereon is fabricated of a soft flexible thermally conductive material in the manner described below in greater detail. Suffice it to note here, however, that the flexibility of thermally conductive wheel 54 facilitates its use upon curved surfaces which would not be easily stamped or embossed using prior art rigid roller-type stamps. It should also be noted that while thermally conductive wheel 54 is shown in a somewhat narrow disk shape relative to its diameter, the present invention applies equally well to provide a thermally conductive wheel which is substantially wider or drum-like as opposed to the wheel-like fabrication shown in FIG. 5.

It will be apparent to those skilled in the art that while FIGS. 1 through 5 have set forth an example of a two facet stamp 20 and a thermally conductive wheel stamp 50 for purposes of illustration, other shapes and facet arrangements may be utilized without departing from the spirit and scope of the present invention. Thus, alternative shapes such as drums or spheres may be utilized for the roller embodiment of the present invention shown in FIG. 5 while other multiple faceted prismatic shapes may be utilized in the manner shown for stamp 20 without departing from the spirit and scope of the present invention.

Figure 6:
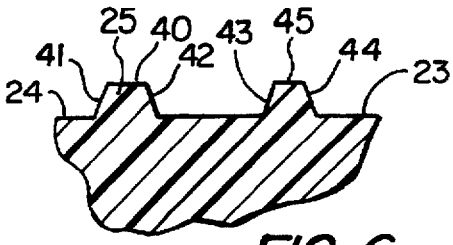
FIG. 6 sets forth a partial section view of the present invention thermally conductive stamp taken along section lines 6—6 in FIG. 4.

FIG. 6 sets forth a partial section view of the present invention stamp taken along section lines 6—6 in FIG. 4. Of importance to note is the presence of heat conductive member 23 having a facet 24 and a plurality of raised image elements 25 extending therefrom all formed from an integral material. Raised image 25 includes by way of example a pair of contact surfaces 40 and 45. In accordance with an important aspect of the present invention, raised image portion 25 includes angled side surfaces 41 and 42 on either side of contact surface 40 and angled side surfaces 43 and 44 on either side of contact surface 45. The use of angled surfaces for all or portions of raised image 25 provides increased thermal conductivity for the supported contact surfaces such as contact surfaces 40 and 45. As mentioned above, the advantage of angled side surfaces adjacent the contact surfaces of image 25 is particularly advantageous in the thinner elements of the image.

As mentioned above, the present invention thermally conductive stamp is preferably fabricated of a soft flexible and resilient thermally conductive material. It has been found that a soft rubber-like substance suitable for the present invention stamp may be fabricated using a material known as Plastisol and aluminum powder. The material is preferably formed by utilizing Plastisol which is a milky liquid at room temperature by adding aluminum powder and mixing. While the ratio of aluminum powder to Plastisol may be varied to achieve the optimum material characteristic for a given application, it has been preferable to mix aluminum powder and Plastisol in a mixture which is approximately sixty percent by weight aluminum and approximately forty percent by weight Plastisol. The resulting mixture is then heated in a mold until cured in a molding process similar to that used in forming conventional doll heads called rotocasting or rotational molding. The material may, by varying the formula of the Plastisol, provide hardnesses which range from very soft and jello-like to a somewhat rigid hard rubber-like material. It has been further found that for most toy vehicles and similar toy applications, the ideal hardness is similar to a typical pencil eraser.

The resulting material provides the flexibility and resilience of other similar materials such as rubber or plastic while simultaneously providing high thermal conductivity which is substantially different from such materials.

Other attempts to make a suitable material for use in the present invention thermally conductive stamp have proven unsuccessful. For example, mixing thermoplastic rubber such as Kraton with aluminum powder is difficult at concentrations higher than forty percent aluminum powder due to the high viscosity of the melted thermal plastic material. Still other materials such as liquid latex have a tendency to become very sticky and undesirable at high concentrations of aluminum powder. Attempts have been made to use other heat conductive fillers such as a metal oxide, for example zinc oxide, with similar difficulties in that the material becomes sticky and unusable at higher concentrations. It has also been found that zinc oxide used in Plastisol exhibits this same tendency to become sticky and unusable. In other efforts, metal powders such as copper or iron have proven to be prohibitively costly and produce unattractive colors as well as providing lower thermal conductivity than aluminum powder.

Thus, in its preferred form, the present invention thermally conductive stamp is fabricated of the above-described combination of Plastisol and aluminum powder. The result is a low cost, easy to manufacture and effective thermally conductive stamp which exhibits sufficient flexibility to conform to various curved toy surfaces as described above.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in imposing an image upon a toy object, the combination comprising:

a toy object having a curved surface covered with a thermochromic material;

a thermally conductive stamp comprising:

a handle;

a flexible large high thermal capacity body secured to said handle and defining a flexible surface; and a flexible thermally conductive image portion, substantially smaller than said body and being raised from, supported by and thermally coupled to said flexible surface thereof, said flexible thermally conductive image portion defining a contact surface and divergent angled sides extending from said contact surface to said flexible surface, whereby subjecting said object and said body to substantially different temperatures after which said image portion is forced against a portion of said curved surface and conforms thereto whereby heat is transferred between the contacted portion of said curved surface and said thermally conductive image portion to form an image.

2. A thermally conductive stamp as set forth in claim 1 wherein said flexible large high thermal capacity body and said image portion are formed of a mixture of Plastisol and aluminum powder.

3. A thermally conductive stamp as set forth in claim 2 wherein said mixture is approximately sixty percent by weight of aluminum powder and approximately forty percent by weight Plastisol.

4. A thermally conductive stamp as set forth in claim 3 wherein said flexible surface defines a facet supporting said raised image portion formed thereon.

5. A thermally conductive stamp as set forth in claim 4 wherein portions of said raised image portion defines contact surfaces and angled side surfaces extending from said contact surfaces to said facet.

6. A thermally conductive stamp as set forth in claim 3 wherein said flexible large high thermal capacity body defines a cylinder having an outer cylindrical surface.

7. A thermally conductive stamp as set forth in claim 6 wherein said outer cylindrical surface includes a plurality of said raised image portions.

8. A thermally conductive stamp as set forth in claim 7 wherein portions of said raised image portion define contact surfaces and angled side surfaces extending from said contact surfaces to said outer cylindrical surface.

9. A thermally conductive stamp as set forth in claim 1 wherein said thermally conductive body defines a facet having said raised image portion formed thereon.

10. A thermally conductive stamp as set forth in claim 9 wherein portions of said raised image portion define contact surfaces and angled side surfaces extending from said contact surfaces to said facet.

11. A thermally conductive stamp as set forth in claim 1 wherein said thermally conductive body defines a cylinder having an outer cylindrical surface.

12. A thermally conductive stamp as set forth in claim 11 wherein said outer cylindrical surface includes a plurality of said raised image portions.

13. A thermally conductive stamp as set forth in claim 12 wherein portions of said raised image portion define contact surfaces and angled side surfaces extending from said contact surfaces to said outer cylindrical surface.

* * * * *